United States Patent [19]

Greive et al.

[11] 4,180,967

[45] Jan. 1, 1980

[54] CABLE-TWISTING TWO YARNS

[75] Inventors: Aloys Greive, Munster; Aloys Horstmann, Greven, both of Fed. Rep. of Germany

[73] Assignee: Hamel GmbH - Zwirnmaschinen, Münster, Fed. Rep. of Germany

[21] Appl. No.: 886,802

[22] Filed: Mar. 15, 1978

[30] Foreign Application Priority Data

Jun. 13, 1977 [DE] Fed. Rep. of Germany ..... 2726603
Dec. 21, 1977 [DE] Fed. Rep. of Germany ..... 2757138

[51] Int. Cl.[2] ..... D01H 9/00; D01H 13/04

[52] U.S. Cl. ..... 57/66; 57/58.83; 57/276; 57/352

[58] Field of Search ..... 57/1 R, 34 R, 58.7, 57/58.83, 59, 66, 106, 127.5, 276, 281, 352; 242/131, 131.1

[56] References Cited

U.S. PATENT DOCUMENTS

| | | | |
|---|---|---|---|
| Re. 24,380 | 10/1957 | Vibber | 57/58.7 X |
| 1,003,026 | 9/1911 | Bartmann | 242/131 X |
| 1,778,284 | 10/1930 | Swanson | 242/131.1 X |
| 1,881,598 | 10/1932 | Hubbard | 57/59 |
| 2,035,690 | 3/1936 | de Ferranti | 57/352 X |
| 2,209,203 | 7/1940 | Kahlisch | 242/131.1 |
| 3,304,026 | 2/1967 | Bucklow et al. | 242/131 |
| 3,805,556 | 4/1974 | Planck, Jr. et al. | 242/131 X |
| 3,949,946 | 4/1976 | Rohner et al. | 242/35.5 R |

FOREIGN PATENT DOCUMENTS

| | | | |
|---|---|---|---|
| 917418 | 9/1954 | Fed. Rep. of Germany . | |
| 1154743 | 9/1963 | Fed. Rep. of Germany . | |
| 1188485 | 3/1965 | Fed. Rep. of Germany . | |
| 72106 | 11/1968 | Fed. Rep. of Germany . | |
| 1760578 | 12/1971 | Fed. Rep. of Germany . | |
| 1168635 | 12/1958 | France | 57/127.5 |
| 1267047 | 6/1961 | France | 57/127.5 |
| 101015 | 11/1916 | United Kingdom . | |

*Primary Examiner*—Charles Gorenstein
*Attorney, Agent, or Firm*—Karl F. Ross

[57] ABSTRACT

An apparatus for twisting together a first and second yarn has a frame extending in a longitudinal direction and carrying a row of upright spindles each having and rotatable about an upright spindle axis. A holder is carried on the frame above each spindle and in turn carries a pair of yarn supplies one which may be the first yarn and one the second, or both the first. When the holder carries both first and second yarn supplies the spindle is operated as a takeup spool and is provided with a traveling-ring arrangement, with the two yarns being pulled off the respective supplies and twisted together. When the holder carries only two supplies of the first yarn the supply of the second yarn can be carried on the spindle, and a separate takeup spool can be provided above the spindle and below the holder. This takeup spool is driven to take up the two yarns and the first yarn is fed from the holder down and then up through the hollow spindle to be twisted with the second yarn that is simultaneously being spun.

26 Claims, 8 Drawing Figures

CABLE-TWISTING TWO YARNS

FIELD OF THE INVENTION

The present invention relates to a yarn-twisting apparatus. More particularly this invention concerns a creel for an apparatus which twists two yarns together.

BACKGROUND OF THE INVENTION

A standard twisting machine supports one or two yarn supplies normally constituted as yarn packages nonrotatable about a spindle axis. The yarn is pulled off the package, down through the spindle and pulled out through radially open holes at the base of the spindle adjacent a storage drum. This spindle and the storage drums are rotated at high speed and the yarn is pulled around the yarn supply to form a so-called balloon. The amount of twist imparted to the yarn is a function of the takeup speed at a takeup spool normally mounted above the yarn supply and rotated at a peripheral speed equal to the takeup speed, and the rotation speed of the spindle.

It has been known to adapt such a machine for a so-called cabling operation whereby two separate yarns, which may be of opposite twist, are wound cable-fashion around each other. Thus in the above-described type of machine the yarn supported on the spindle is not drawn down through the spindle but is drawn directly up through the takeup eye that is normally provided immediately above the spindle on the spindle axis. Another yarn is fed to the lower end of the spindle which is normally tubularly hollow, and is drawn out through the above-mentioned aperture adjacent the storage drum. This second yarn is drawn up around the package of the first yarn and through the same takeup eye. Rotation of the spindle at high speed therefore twists the yarns about each other to form a so-called double yarn of the cable type which is very useful in high-strength applications such as in carpets.

Such a machine therefore requires two separate yarn supplies. As the basic machine is a standard spinning or twisting apparatus, a separate creel is typically provided for the second yarns that are cabled around the first yarns. In most applications the second creel is provided next to but spaced by a gangway from the machine having the first yarns and the takeup spools. Each of the second yarns is led through a relatively long path beneath the gangway to the bottom of the twisting machine.

This arrangement has the considerable disadvantage that it takes up a great deal of floor space. What is more it is an extremely difficult operation to thread a new second yarn into the machine should the supply of the second yarn run out. The operator of such a machine must also keep an eye out to both sides of the gangway, checking on the takeup spools, the packs of first yarn in the basic spinning machine, and the yarn supplies in the creel for the second yarns. Furthermore while tending the creel on one side or the twisting machine on the other the operator must turn his or her back to much of the machinery so that a considerable risk of unobserved malfunctioning exists.

A ring-spinning machine is also known for spinning together a plurality of yarns. A standard spinning spindle is rotated at high speed inside a ring-spinning device comprising a vertically reciprocal ring and a traveler orbitable thereon about the spindle. In this case the several yarn supplies are held on respective pins of a creel above the spindle.

To service such a device, as for instance to replace an empty spool with a full yarn package, it is therefore necessary for the textile worker to reach up over the operating spinning mechanism. Such a procedure not only presents a considerable likelihood that the operator will touch the operating mechanism and thereby interfere with its functioning, but it also stands a good chance of injuring him or her.

OBJECTS OF THE INVENTION

It is therefore an object of the present invention to provide an improved twisting apparatus.

Another object is to provide such an apparatus capable of a cabling operation as described above but which takes up substantially less floor space and which is substantially easier to tend than the prior-art machine.

SUMMARY OF THE INVENTION

These objects are attained according to the present invention in a machine of the above-described general type wherein a holder for the first yarn is supported for displacement on the frame of the machine between an operating position generally above the takeup spool and the spindle and a loading position below the operating position and next to the spool and spindle. Guides are provided on the frame between the holders for the first yarn and the spindle for feeding the first yarn from its supply to the spindle.

According to this invention the supply for the second yarn may be mounted on the holder next to the supply of the first yarn. Both yarns are drawn off their supplies and fed down to the rotating spindle which therefore acts as a takeup spool. A ring-spinning device including a ring vertically reciprocal along and surrounding the spindle and a traveler thereon through which the two yarns pass is provided at the spindle.

It is also possible according to this invention to make the spindle hollow and have it carry the supply of the second yarn, in which case a separate takeup spool is provided above this spindle, which is driven to twist the second yarn, and below the holder which only supports the supply or supplies of the first yarn. In this latter arrangement the first yarns are not fed in a complex relatively long path across a gangway from a creel to the twisting machine, but are carried directly on the twisting machine above the respective supply of first yarn and twisting equipment. The machine according to the invention therefore can have a succession of stations at each of which is located all of the mechanism and supplies for each separate production unit. At a single glance the operator can determine whether there is sufficient yarn in each of the supplies at each station and how each of the twisters is operating. Whenever one of the supplies of the first yarn starts to run out it is a relatively simple task for the operator to swing down the holder and add a new yarn package, without even stopping the twisting operation according to this invention.

According to further features of this invention the holder for the yarn supply or supplies is V-shaped and has a pair of arms lying at an angle of between 100° and 140°, normally 120°, to each other. Each such are carries on its outer end a pin on which is mounted a respective package of the second yarn. Furthermore this entire unit it pivotal by means of a parallelogrammatic linkage between the above-mentioned operating and loading positions, lying all the time in an upright plane including the respective spindle axis. Thus even when swung down into the loading position against the force of a return biasing spring each of the holders still lies immediately next to the respective twisting apparatus. A pawl-type latch is provided which can lock the holder in the lower loading position during replacement of one of the yarn packages. The tail end of the yarn of one package can be connected according to this invention to the loading or starting end of the yarn of the other package in an arrangement where the second yarn supply is carried on the spindle so that there is normally no need to shut the production unit while loading in a new package of the second yarn.

According to further features of this invention where only the first yarn is on the holder the first yarn is guided from whichever package it is being pulled from through a first guide eye which lies in the above-described plane. It then passes generally perpendicularly to this plane through a short distance to a second such eye and then drops down through a guide tube which generally encloses and shields it to the bottom of the machine. This guide tube extends parallel to the spindle axis but is offset from the above-mentioned plane. At the bottom of the guide tube the yarn is deflected again back into the plane and fed into the bottom end of the spindle. Thus during its travel along a mainly vertical path from the yarn holder to the twister the second yarn is made to pass out of the way of most of the mechanism, and where it must run close to the mechanism it passes through a tube which shields it. With this arrangement as the holder is pivoted down from the operating to the loading position the distance between the second guide eye and the top of the guide tube is shortened. Such shortening will have no disadvantageous effects on the operation of the machine if a thread brake is provided between the lower end of the tube and the lower end of the spindle for the first yarn. Another such thread brake may be provided at the second guide eye.

According to yet another feature of this invention each of the above-described pins of the holder for the first yarn may be pivotal out of the operating plane of the respective production unit for loading of a new package onto the holder. Such lateral pivoting makes it a relatively simple operation to take off an empty yarn package core and place a new yarn package on the empty pin, securing the starting end of the yarn of the new package to the tail end of the other package. These two pins extend perpendicular to the respective arms and the above-mentioned first guide eye is provided at the intersection of their longitudinal axes.

The machine according to the present invention therefore is extremely compact. Even though it carries several yarn supplies and indeed functions to produce a cable-type yarn which normally requires considerable machinery, it takes up no more floor space than the standard yarn-twisting machine. Each production unit is relatively narrow and adding the necessary structure to an existing twisting machine to give it a cabling capacity in no way increases the size horizontally of any of its production units, but merely increases the overall height of the assembly. During normal operation of the machine the yarn packages for the first yarn are well up out of the way, and need only be swung down for replacement of one of these packages.

SPECIFIC DESCRIPTION

Figure 1:
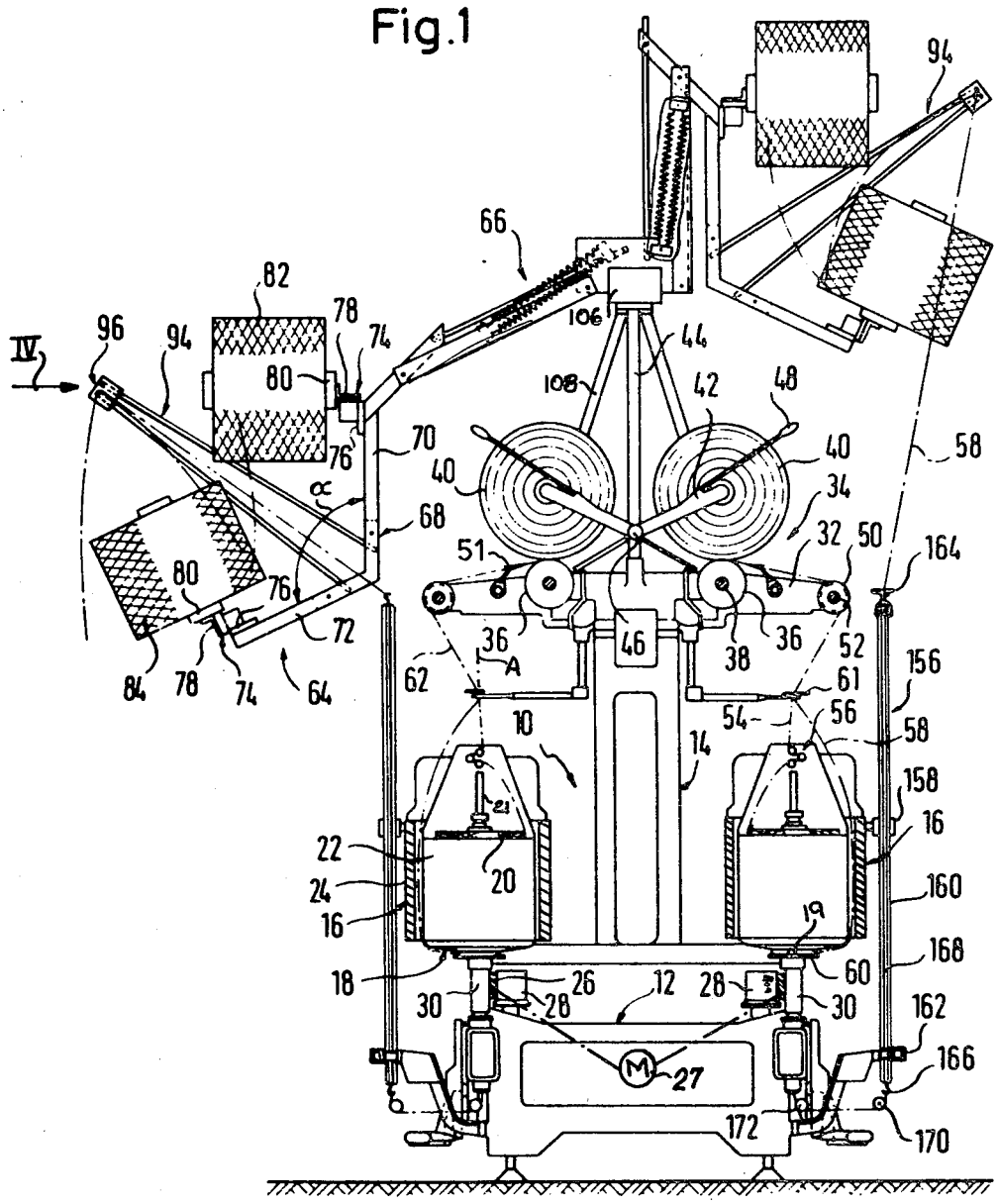
FIG. 1 is an end view of the machine according to this invention.
Figure 2:
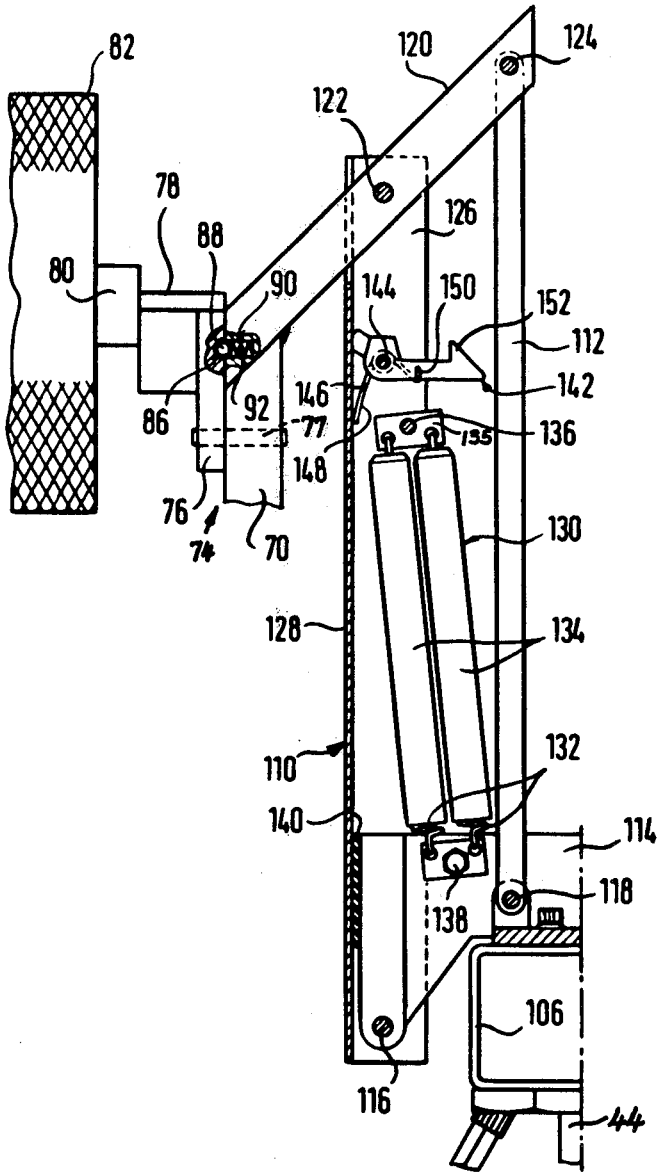
FIGS. 2 and 3 are large-scale end views of details of the apparatus of FIG. 1 in the operating and loading positions, respectively.
Figure 3:
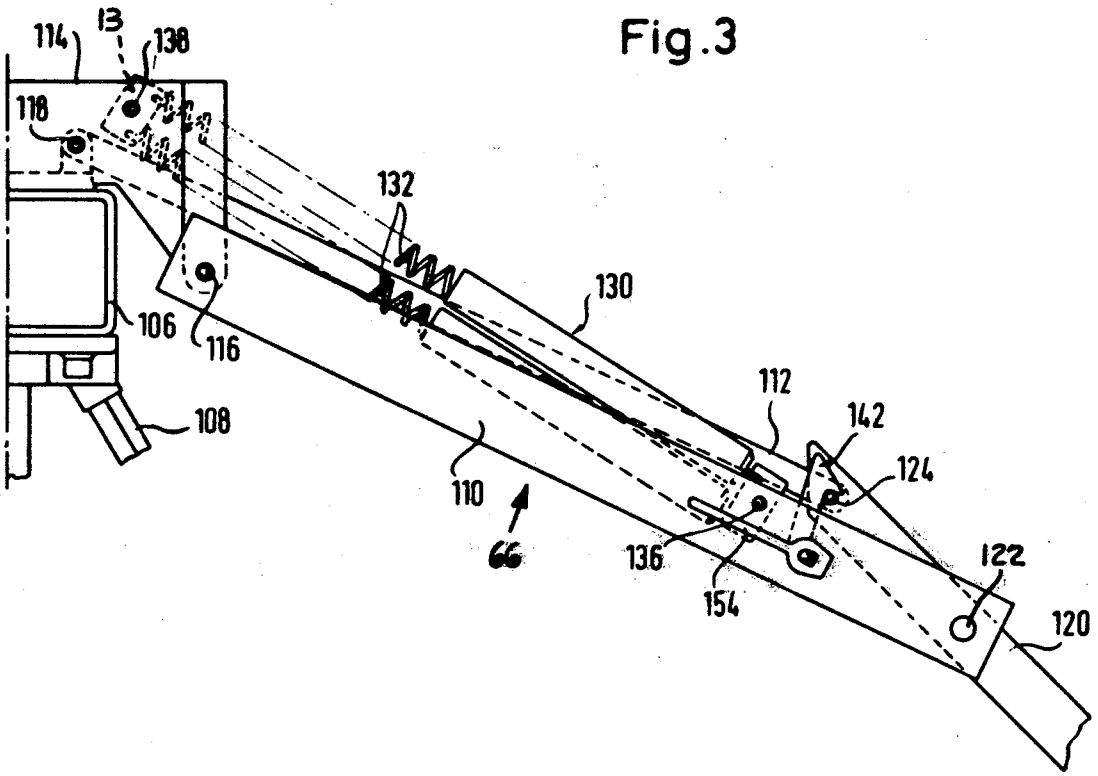

As shown in the drawing in FIGS. 1–4 the apparatus according to the invention basically comprises a frame 10 extending longitudinally in a direction perpendicular to the plane of view in FIGS. 1–3 and having a lower frame portion 12 and an intermediate portion 14. Two rows of twisters 16 are provided on this frame 10 at the lower portion 12 and immediately above each of the twisters 16 is a respective takeup device 34. Above each of the takeup devices in turn is a respective creel or second yarn supply 64. FIG. 1 shows two side-by-side production units each having a respective twister 16, takeup device 34, and creel 64. A gangway is provided to each longitudinal side of the frame 10.

Each twister 16 basically comprises a rotor 18 having a storage drum 60 formed with an aperture 19 and by a spindle 21 supported nonrotatably on the rotor 18 and carrying a yarn package 20 of a first yarn 54. Closely surrounding the yarn package 20 is a balloon-limiting sleeve 22 fixed to the rotor 18 and coaxially surrounding this cylindrical sleeve 22 is a wind-shield sleeve 24 forming an annular cylindrical space therewith. The wind-shield sleeve 24 is fixed to the frame portion 12 and is therefore nonrotatable. Magnets coacting through nonmagnetic sleeve 22 with structure connected to the yarn package 20 prevent it from rotating as the rotor 18 turns at high speed.

A drive belt 26 operated from a motor 27 is pressed by idler rollers 20 against whorls 30 formed at the bottom of the rotors 18.

A transverse beam 32 above each pair of twisters 16 supports the two identical takeup devices 34. Each such device has a takeup drum 36 mounted on a shaft 38 extending parallel to the longitudinal direction of the machine and rotated at a predetermined speed by the motor 27. A takeup spool 40 frictionally engages the drum 38 and is carried on an arm 42 journaled at 46 on a post 44 extending upwardly from the intermediate portion 14 of the frame. A handle 48 connected to each of the arms 42 can be raised to lift the spool 40 off the continuously driven roller 38 for removal of a full spool.

In accordance with the invention the yarn 54 is pulled upwardly off the package 20 and through a three-roller thread brake 56 and thence through an eye 61 centered on the axis A about which the rotor 18 rotates. Thence the filament 54 passes over a deflecting yarn-guide roller 50 and through a traversing yarn guide 51 which may also function to detect a break in the yarn passing through it to the takeup spool 40.

A second yarn 58 is combined as will be described below with the yarn 54 to form a cabled double yarn 62.

It is noted that if this yarn 58 is not used the apparatus can be operated as a normal spinning machine with the yarn 54 being pulled from the pack 20, down through the spindle 21, thence out through the aperture 19 onto the storage disk or drum 60 and thence up through the space between the sleeves 24 and 22 to the eye 61. Indeed two packages 20 can be mounted on the spindle 21 for doubling of the yarn during twisting.

Figure 4:
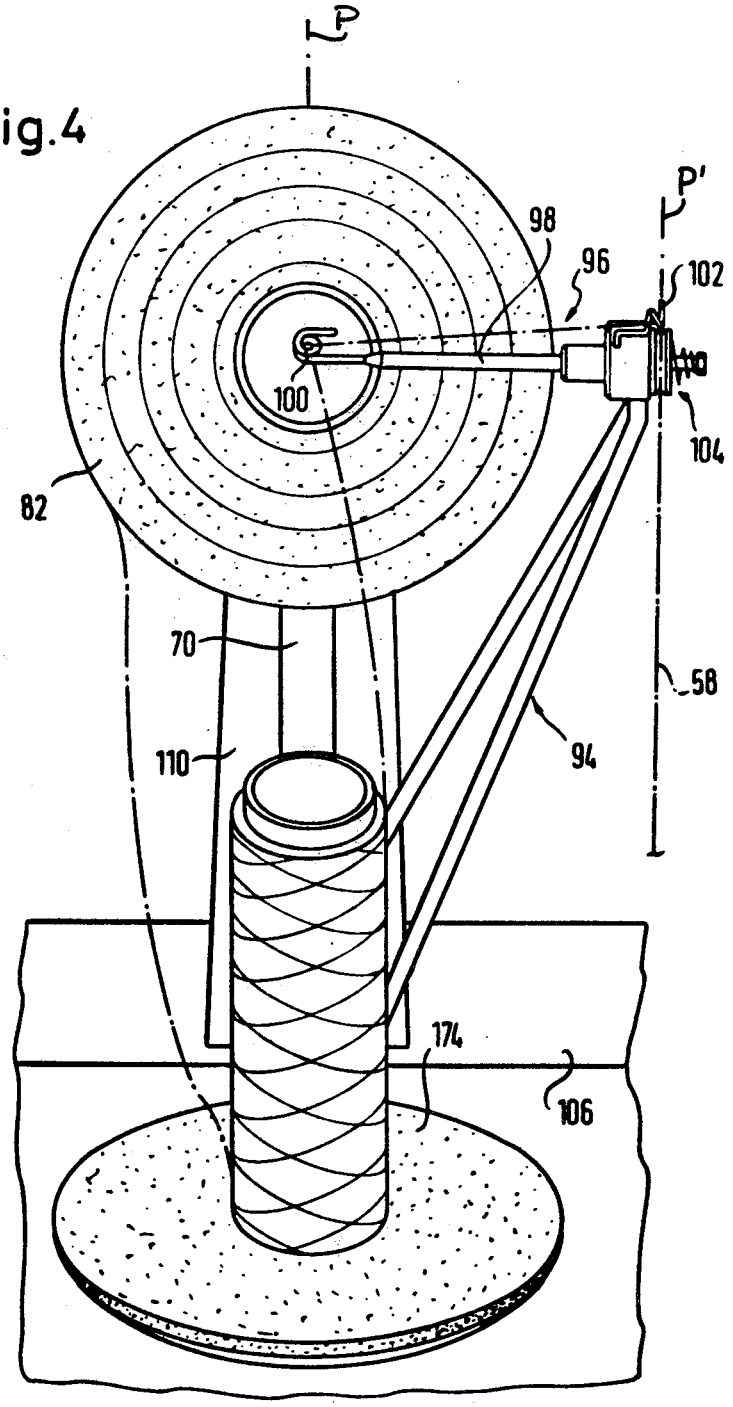
FIG. 4 is a large-scale view taken in the direction of arrow IV of FIG. 1.

As shown in more detail in FIGS. 2–4 provided above each twister 16 is a yarn holder 64 having a frame 68 and carried on a pivoting arrangement 66. The frame 68 is of V-shape and has a pair of arms 70 and 72 each carrying a respective mount 74 at its outer end. Each mount 74 as best shown in FIG. 2 comprises a base part 76 pivotal about a pin 77 on the respective arm and having a portion 78 on which is provided a mounting pin 80 for either of two yarn packages 82 and 84. The two pins or spindles 80 extend at an angle $\alpha$ of 120° to each other. In addition each mount 74 allows for pivoting of the respective yarn package about the axis pin 77 relative to the respective arm. A latching device in the form of a semispherical recess 66 formed in the part 76 and a cylindrical recess 90 carrying a ball 88 engageable in the recess under the force of a spring 92 is provided.

As shown in FIG. 4 the two arms 70 and 72 lie in a plane P which includes the axis A of the spindle 21 of the respective twister 16.

A pair of struts 94 extend upwardly from the arms 70 and 72 and carry at their upper end a thread-guide arrangement 96 constituted by a stem 98 on the inner end of which is provided a typical thread eye or guide 100 and on the outer end of which is provided another such thread guide or eye 102 and a standard spring-loaded thread brake 104. The eye 100 lies at the intersection of the axes of the pins or spindles 80 and in the plane P whereas the eye 102 lies outside of this plane P and indeed in a plane P′ parallel thereto but offset in the longitudinal direction of the machine.

At the upper ends of the posts 44 the machine carries a longitudinal beam 106 on which are supported the inner ends of the parallelogrammatic linkage 66 best shown in FIGS. 2 and 3. A pair of struts 108 extending downwardly from the beam 106 make the entire upper assembly very rigid on the frame 10 of the machine.

Each parallelogrammatic linkage comprises a pair of relatively long links 110 and 112 connected together at their inner ends at respective pivot pins 116 and 118 on a flange or inner link member 114 fixed to the beam 106. These pivot pins 116 and 118 are perpendicular to the planes P and spaced both vertically and horizontally perpendicular to the longitudinal direction of the machine. At their outer ends the two links 110 and 112 are pivoted at respective pivot pins 122 and 124 on an outer arm 120 whose outer end is welded or flanged to the outer end of the one leg 70 of the V-shaped holder frame 64. The link 110 is of U-section and has a pair of parallel flanges or legs 126 in which are journaled the pivot pins 116 and 122 and which flank and receive most of the structure of the parallelogrammatic linkage 66, and a web 128 interconnecting these two flanges 126.

A spring assembly 130 constituted by a pair of tension springs 132 received in respective shield tubes 134 has an end plate 135 pivoted at 136 between flanges 126 of the link 110 adjacent the pivot pin 122, and at the other end has another plate 137 secured at 138 above the pivot pin 118 and between the pivot pins 116 and 118 to the flange 114. This spring arrangement 130 normally biases the parallelogrammatic linkage 66 into the operating position of FIG. 2 from the loading position of FIG. 3. A bumper strip 140 is provided on the face of the flange 114 to engage the inner surface of the web 128 in the operating position so as to cushion return of the assembly to this operating position and to hold it snugly and vibrationless in place therein.

In order to lock the parallellogrammatic linkage in the loading position a hooked pawl 142 is pivoted at 144 on the link 110 at the flanges 126 thereof between the pivot pins 122 and 136. A torsion spring 146 has one leg 148 bearing on the web 128 and another leg 150 hooked over the pawl 142 to urge the hook 152 thereof over the pivot pin 124 between the links 112 and 120 in the working position. Thus when pulled down into this working position this spring-loaded pawl 142 will automatically snap over the pin 124 and hold the device in the working position. A lever 154 fixed to the pivot pin 144 allows the pawl 142 to be swung back and unhooked from the pin 124 so that the parallelogrammatic linkage 66 can automatically return to the operating position of FIG. 2.

From the yarn guide 102 and thread brake 104 of FIG. 4 the second yarn 58 is led down through a guide arrangement 156 fixed at clips 158 and 162 to the machine frame and constituted mainly by a vertical tube 160 lying in the plane P′. A yarn guide or eye 164 is provided at the top end of the tube 160 and another such guide or eye 166 at the bottom end thereof. The tube 160 is formed with a vertically and longitudinally throughgoing slit 168 to allow easy feeding of the yarn 58 into it. A roller-type thread brake 170 is provided below the eye 166 to guide the yarn from the eye 166 to another deflector roller 172 directly below the lower end of the respective spindle 21. Thus the rollers 170 and 172 deflect the yarn 58 back from the plane P′ to the plane P.

The yarn 58 is led up through the hollow spindle 21 to the aperture 19 where it exits onto the storage drum 60 and then passes up through the balloon space between the sleeves 22 and 24. Thereafter the yarn 58 passes through the eye 61 where it is twisted around the yarn 54. The combined yarn 62 is then wound up onto the takeup spool 40 as described above.

Each of the yarn packages 80 and 81 has a respective core 174. Furthermore the tail end of the yarn on the one package 80 is tied to the starting end of the yarn on the other package 82. When one of the packages runs out therefore yarn continues to be fed from the other package. The operator in charge of the machine then grabs the frame 68 and pulls the entire creel arrangement down from the position shown above and to the right in FIG. 1 to the position shown to the left in FIG. 1. This brings the two spools 82 and 84 down to eye level so that the operator can easily pivot the pin 80 of the empty core 174 to the side and replace the empty core 174 with a new yarn package. The starting end of the yarn of the new package is tied to the tail end of the other package from which yarn can continue to be payed out.

Figure 5:
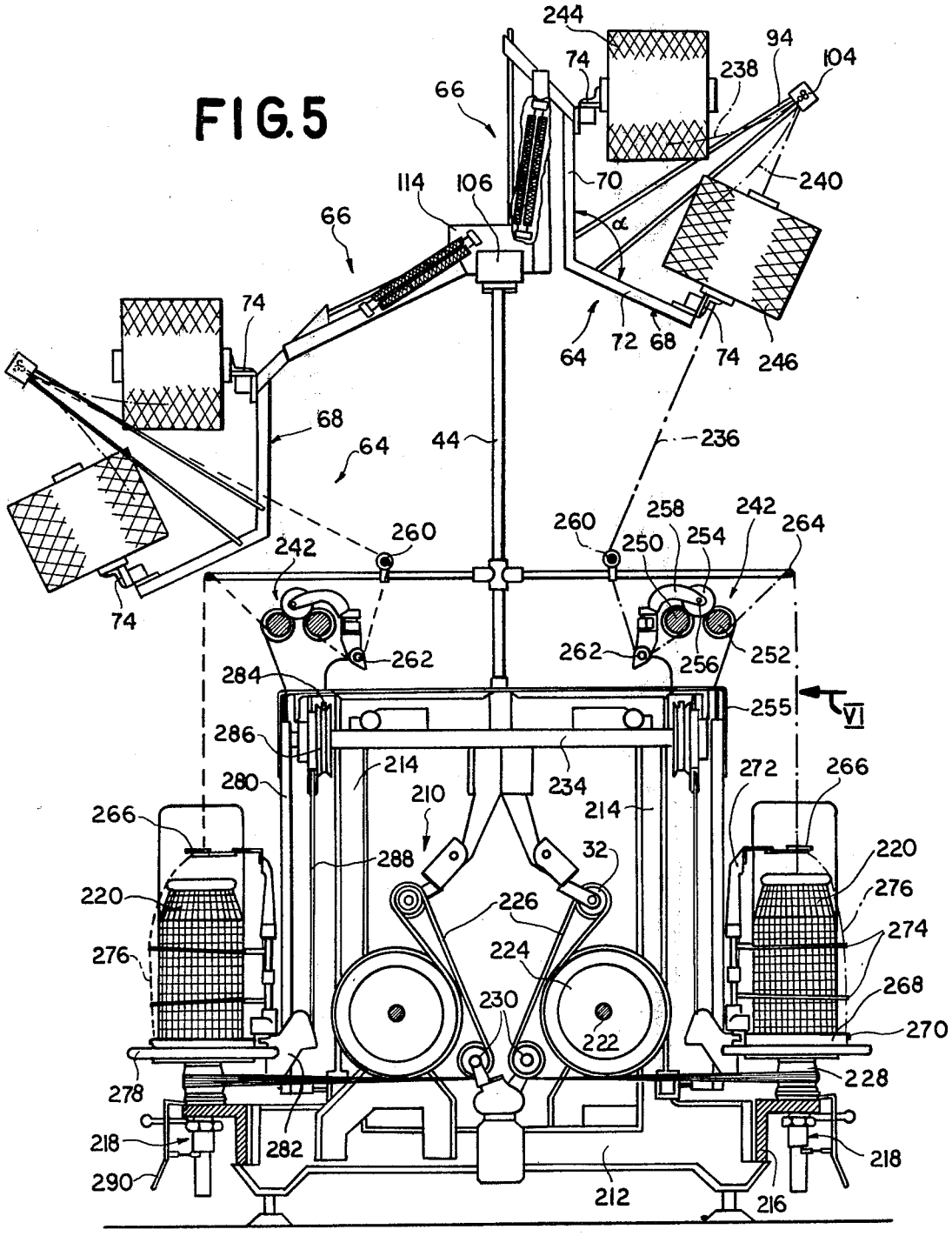
FIG. 5 is a view similar to FIG. 1 showing another twisting/cabling machine according to this invention.
Figure 6:
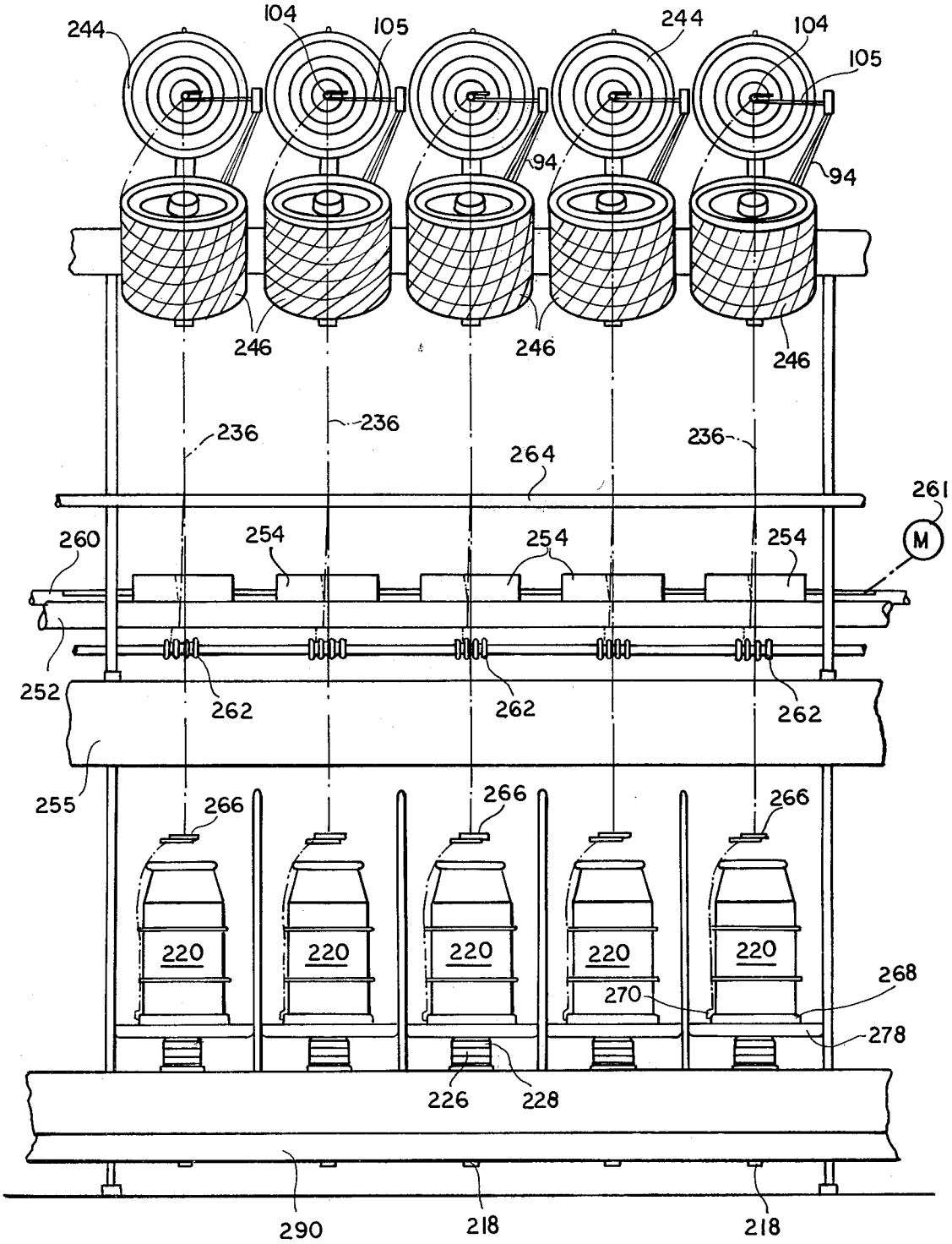
FIG. 6 is a view taken in the direction of arrow VI of FIG. 5.

In the arrangement of FIGS. 5 and 6 the same reference numerals as in FIGS. 1–4 are used for functionally identical structure.

Here the machine has a frame 210 having a lower frame 212 and an intermediate frame 214 supporting the center post 44. A longitudinally extending spindle bank 216 has a plurality of upright spindles 218 which each support a takeup package 220 as best shown in FIG. 6.

A horizontal drive shaft 222 extends longitudinally along each spindle bank 216 and carries a drive wheel 224 for each of the spinning spindles 218. A drive belt 226 reeved over each wheel 224 engages a whorl 228 of each spindle 218, passes over a deflector roller or wheel 230, and is tensioned by a spring-loaded wheel or roller 232.

Each holder or loader frame 68 carries a supply 244 of a first yarn 238 and a supply 246 of the second yarn 240 which are combined at the first guide and thread brake 104 to form a combined cabled yarn 236 that passes downwardly and around a shaft 260 passing longitudinally and horizontally past and above all of the spindles 218 and then under a respective guide 262 below the shaft 260. The cabled filament 236 then passes through a drive or feed device 242 comprised of a pair of lower rollers 250 and 252 both engaging another upper roller 254 carried on a common shaft 260 again passing longitudinally through the machine and carried on a shaft 256 driven by a motor 261. Thereafter the yarn 236 passes up and over another guide rod 264 again passing longitudinally along the machine and drops directly downwardly and axially through an eye 266 above and on the axis of the respective spindle 218. A longitudinal beam 255 extending along the machine and secured to the outer ends of a transverse beam 234 of the intermediate frame 212 supports these drive arrangements 242.

Each spindle 218 and its respective spool 220 is surrounded by a respective ring 268 having a traveler ring 270 through which the filaments 236 pass. A pair of balloon-limiting rings 274 carried on an upright 272 extending upwardly from a ring stand 278 confine the balloon 276 formed by the cabled yarns between the guide eye 266 and the traveler ring 270 as it orbits about the spindle 218.

Each ring stand 268 is carried on a slide shoe 282 vertically slidable along an upright rail 280 adjacent each spindle 218. A rotatable wheel 286 carried on the end of the transverse beam 234 is continuously engaged by a longitudinally continuously reciprocated drive element 285 and a flexible cable 288 wound on the wheel 286 can therefore vertically reciprocate and stroke the stand 278 as the element 284 is horizontally reciprocated. Thus the cabled filaments 236 are neatly wound up on the package 220.

Each spindle 218 is provided with a brake 290 that allows it to be rotationally arrested without stopping the respective drive shaft 222.

In this arrangement the two yarns 238 and 240 are drawn off the respective supplies 244 adn 246 and combined right on the holder 64. They are then fed down as a double yarn 238 to the ring-spinning spindle 218 where they are wound up and simultaneously given the desired twist.

Figure 8:
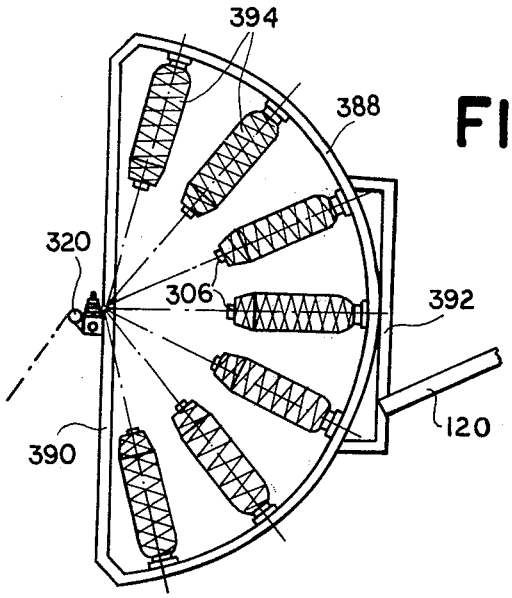
FIGS. 7 and 8 are views of other yarn-supply holders according to this invention.
Figure 7:
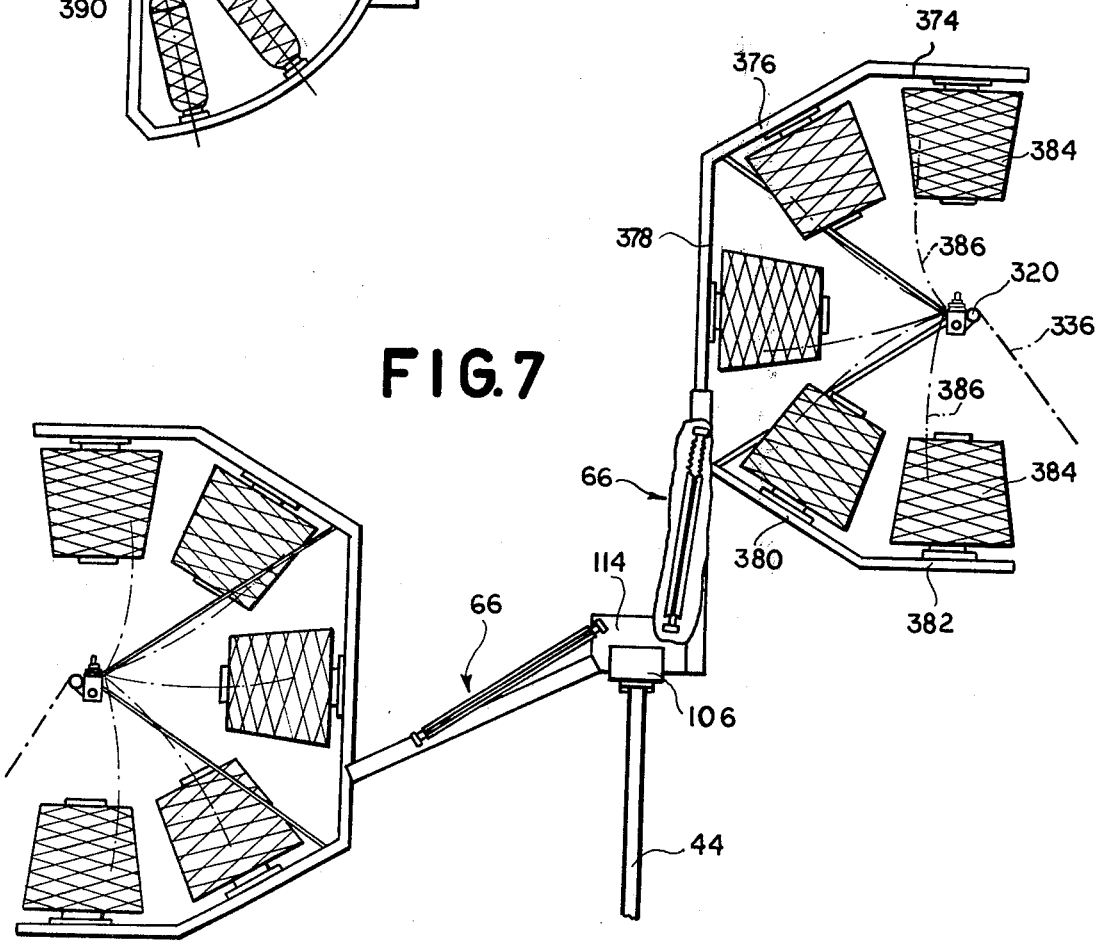

In FIGS. 7 and 8 arrangements are shown for carrying more than two yarn supplies. The arrangement of FIG. 7 allows four packages 384 each having a respective yarn 386 to be carried on a support having a large central arm 378 and at one end two further arms 374 and 376 and at the other end two further arms 380 and 382. The arms 374 and 382 are parallel to each other and perpendicular to the arm section 378. A thread brake 32 is provided at the center of this arrangement, mounted on a lateral arm 105 as shown in FIG. 5, and the combined filament 336 passes off as in FIGS. 5 and 6.

The arrangement of FIG. 8 simply allows a C-shaped frame 388 mounted on a support piece 392 and bridged by an end piece 390 carrying the thread brake 320 to carry seven packages 394 whose axes 306 all meet at the brake 320. In these last two arrangements even a relatively large creel can be serviced with ease. The operator of the machine can pull down the entire arrangement without interfering with the mechanism below it or risking injury.

During the entire operation of these machines, as in FIGS. 1–4, there is no need to shut the machine down as the mechanism being attended to lies completely out of the path of the yarn still being fed off. After the new package has been positioned the operator need merely flip the handle 154 to allow the spring arrangement 130 to pull the parallelogrammatic linkage 66 back into the operating position. In such a position the spools are completely out of the way and it is a relatively easy matter for the operator to attend to any of the other parts of the machine below it.

We claim:

1. An apparatus for twisting together a first and a second yarn, said apparatus comprising:

a frame;

respective first and second holders respectively adapted to support supplies of the first and second yarns;

a rotatable takeup spool on said frame underneath said first holder;

support means for displacement of said first holder on said frame generally in an upright plane between an operating position relatively far above said takeup spool and a loading position below and horizontally offset from said operating position;

respective first and second guide means between said first and second holders and said takeup spool for feeding said first and second yarns from said first and second supplies to said takeup spool, said first guide means defining a first guide path offset from said plane; and takeup drive means for rotating said takeup spool and thereby winding said first and second yarns up on said spool.

2. An apparatus for twisting together a first and a second yarn, said apparatus comprising:

a frame;

a generally V-shaped first holder having a pair of arms each having an outer end provided in turn with an elongated support pin adapted to carry a respective supply of said first yarn, whereby the tail end of said first yarn of one of said supplies can be connected to the starting end of the other of said supplies, said pins being relatively inclined;

a second holder adapted to support a supply of said second yarn;

a rotatable takeup spool on said frame underneath said first holder;

support means pivotally supporting said first holder on said frame for displacement substantially in an upright plane between an operating position relatively far above said takeup spool and a loading position below and horizontally offset from said operating position, said pins and arms being generally coplanar and in said plane;

respective first and second guide means between said first and second holders and said takeup spool for feeding said first and second yarns from said first and second supplies to said takeup spool;

a yarn guide on said first holder and lying generally at the intersection of the longitudinal axes of said pins and between said supplies of said first yarn and said first guide means, said yarn guide being displaceable substantially in said plane on displacement of said first holder between said operating and loading positions;

means for pivoting each of said pins between an inner position on said plane and an outer position offset from said plane; and takeup drive means for rotating said takeup spool and thereby winding said first and second yarns up on said spool.

3. An apparatus for twisting together a first and a second yarn, said apparatus comprising:

a frame;

respective first and second holders respectively adapted to support supplies of the first and second yarns;

a rotatable takeup spool on said frame underneath said first holder;

support means pivotally supporting said first holder on said frame for displacement substantially in an upright plane between an operating position relatively far above said takeup spool and a loading position below and horizontally offset from said operating position and generally level with said takeup spool, said support means being a parallelogrammatic linkage including a pair of generally parallel long links having inner ends pivoted at respective inner pivot axes on said frame and an outer transverse link carrying said first holder, said long links having outer ends pivoted at respective outer pivot axes on said outer transverse link, said pivot axes all being substantially parallel and perpendicular to said plane;

respective first and second guide means between said first and second holders and said takeup spool for feeding said first and second yarns from said first and second supplies to said takeup spool; and takeup means for rotating said takeup spool and thereby winding said first and second yarns up on said spool.

4. The apparatus defined in claim 3, further comprising biasing means urging said linkage into said operating position.

5. The apparatus defined in claim 4 wherein said biasing means includes at least one spring connected between said frame and one of said links.

6. The apparatus defined in claim 4, further comprising means for latching said linkage releasably in said loading position.

7. The apparatus defined in claim 6 wherein said means for latching includes at least one pawl on one of said links pivotally operatively engageable with another of said links.

8. The apparatus defined in claim 7 wherein said linkage includes pivot pins at said pivot axes, said pawl being engageable over one of said pins and said means for latching further comprising spring means for urging said pawl into a position hookable over said one pin.

9. The apparatus defined in claim 8, further comprising a handle on said pawl operable for displacing same against the force of said spring means and out of said position hookable over said one pin.

10. An apparatus for twisting together a first and a second yarn, said apparatus comprising:

a frame;

respective first and second holders respectively adapted to support supplies of the first and second yarns;

a rotatable takeup spool on said frame underneath said first holder;

support means pivotally supporting said first holder on said frame for displacement substantially in an upright plane between an operating position far above said takeup spool and a loading position below and horizontally offset from said operating position;

respective first and second guide means between said first and second holders and said takeup spool for feeding said first and second yarns from said first and second supplies to said takeup spool, said first guide means including an upright guide tube fixed on said frame and eyes at the upper and lower ends of said guide tube, said tube being formed along its entire vertical length with a slot;

a thread brake for said first yarn between said lower end and said takeup spool;

a yarn guide on said first holder between said supply of said first yarn and said first guide means and displaceable substantially in said plane on displacement of said first holder between said operating and loading positions; and takeup drive means for rotating said takeup spool and thereby winding said first and second yarns up on said spool.

11. An apparatus for twisting together a first and a second yarn, said apparatus comprising:

a frame;

respective first and second holders respectively adapted to support supplies of the first and second yarns;

a rotatable takeup spool on said frame underneath said first holder;

support means pivotally supporting said first holder on said frame for displacement substantially in an upright plane between an operating position relatively far above said takeup spool and a loading position below and horizontally offset from said operating position;

respective first and second guide means between said first and second holders and said takeup spool for feeding said first and second yarns from said first and second supplies to said takeup spool, said first guide means including a generally vertical guide tube fixed on said frame and offset from said plane;

a yarn guide on said first holder between said supply of said first yarn and said first guide means and displaceable substantially in said plane on displacement of said first holder between said operating and loading positions; and takeup drive means for rotating said takeup spool and thereby winding said first and second yarns up on said spool.

12. An apparatus for twisting together a first and a second yarn, said apparatus comprising:

a frame;

respective first and second holders respectively adapted to support supplies of the first and second yarns;

a rotatable takeup spool on said frame underneath said first holder;

support means for displacement of said first holder on said frame between an operating position relatively far above said takeup spool and a loading position below and horizontally offset from said operating position, said first holder being level with said takeup spool in said loading position;

respective first and second guide means between said first and second holders and said takeup spool for feeding said first and second yarns from said first and second supplies to said takeup spool; and takeup drive means for rotating said takeup spool and thereby winding said first and second yarns up on said spool.

13. The apparatus defined in claim 12 wherein said first holder is supported on said support means pivotally and moves substantially in an upright plane on pivoting of said first holder between said positions.

14. The apparatus defined in claim 12 wherein said first holder has a yarn guide between said supply of said first yarn and said first guide means and displaceable substantially in said plane on displacement of said first holder between said operating and loading positions.

15. The apparatus defined in claim 14 wherein said first holder has a pair of elongated support pins each adapted to carry a respective supply of said first yarn and inclined to each other, said yarn guide lying generally at the intersection of the longitudinal axes of said pins, whereby the tail end of said first yarn of one of said supplies of said first yarn can be connected to the starting end of the other of said supplies of said first yarn.

16. The apparatus defined in claim 15 wherein said first holder is generally V-shaped and has a pair of arms each having a respective outer end carrying a respective one of said pins, said pins and arms being generally coplanar and in said plane.

17. The apparatus defined in claim 16 wherein said apparatus has a row of such takeup spools, holders, and guide and takeup means in and defining a longitudinal direction, said planes being generally perpendicular to said direction.

18. The apparatus defined in claim 17 wherein said first guide means includes a second yarn guide adjacent the first guide on said first holder and offset from said plane, said first yarn being threaded from its supply through said first guide, then through said second guide, and then through said first guide means to said takeup spool.

19. The apparatus defined in claim 18, further comprising a thread brake for said other yarn at one of said guides.

20. The apparatus defined in claim 16 wherein said arms extend at an angle between 100° and 140° to each other.

21. The apparatus defined in claim 14 wherein said first guide means includes an upright guide tube fixed on said frame.

22. The apparatus defined in claim 21 wherein said guide tube is formed along its entire vertical length with a slot.

23. The apparatus defined in claim 22 wherein said guide means includes eyes at the upper and lower ends of said guide tube.

24. An apparatus for twisting together a first and a second yarn, said apparatus comprising:

a frame;

a tubular spindle rotatable on said frame about an upright spindle axis;

a first holder adapted to support a supply of said first yarn;

a second holder on said spindle and adapted to support a supply of said second yarn, said spindle being formed below said second holder with a radially open aperture;

a rotatable takeup spool on said frame underneath said first holder and above said spindle;

support means for displacement of said first holder on said frame between an operating position relatively far above said takeup spool and a loading position below and horizontally offset from said operating position;

respective first and second guide means between said first and second holders and said takeup spool for feeding said first and second yarns from said first and second supplies to said takeup spool;

takeup drive means for rotating said takeup spool and thereby winding said first and second yarns up on said spool; and spindle drive means connected to said spindle for rotating same about said spindle axis and thereby twisting said first and second yarns together.

25. The apparatus defined in claim 24 wherein said spindle is provided at said aperture with a storage drum.

26. The apparatus defined in claim 24, further comprising an eye above said spindle on said spindle axis, both of said yarns passing through said eye before engaging said takeup spool.

* * * * *